US006520355B1

(12) United States Patent
Pritchard et al.

(10) Patent No.: US 6,520,355 B1
(45) Date of Patent: Feb. 18, 2003

(54) ADJUSTABLE SHELVING/DISPLAY SYSTEM

(75) Inventors: David Mark Pritchard, Gurnee, IL (US); Joseph Anthony Sawicki, Gary, IL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/534,925

(22) Filed: Mar. 23, 2000

Related U.S. Application Data

(60) Provisional application No. 60/126,457, filed on Mar. 26, 1999.

(51) Int. Cl.[7] ..... A47B 5/00

(52) U.S. Cl. ..... 211/187; 211/94.01; 211/184

(58) Field of Search ..... 211/187, 186, 211/184, 90.02, 90.04, 94.01, 103

(56) References Cited

U.S. PATENT DOCUMENTS

| | | | | | |
|---|---|---|---|---|---|
| 2,885,091 | A | * | 5/1959 | Van Pelt | 211/184 |
| 2,965,242 | A | | 12/1960 | Grotke | |
| 2,991,889 | A | | 7/1961 | Levy et al. | |
| 3,160,281 | A | | 12/1964 | Ruhnke | |
| 3,285,424 | A | * | 11/1966 | Emery | 211/55 |
| 3,502,292 | A | | 3/1970 | Yoder | |
| 3,750,893 | A | | 8/1973 | Kempler | |
| 3,868,021 | A | * | 2/1975 | Heinrich | 211/184 |
| 3,971,477 | A | | 7/1976 | Bruderly et al. | |
| 4,046,083 | A | | 9/1977 | Murdoch et al. | |
| 4,068,855 | A | | 1/1978 | Hackett | |
| 4,127,196 | A | | 11/1978 | Boucher | |
| 4,138,019 | A | * | 2/1979 | Smith | 211/87.01 |
| 4,199,069 | A | | 4/1980 | Talarico | |
| 4,561,550 | A | * | 12/1985 | Franklin | 211/184 |
| 4,631,881 | A | * | 12/1986 | Charman | 52/220 |
| 4,693,383 | A | | 9/1987 | Fenwick | |
| 4,744,475 | A | | 5/1988 | St. Pierre | |
| 4,829,977 | A | | 5/1989 | Valentine | |
| 4,887,783 | A | * | 12/1989 | Franklin | 248/220.4 |
| 4,917,442 | A | * | 4/1990 | Johnson | 301/113 |
| 4,919,282 | A | | 4/1990 | Duff et al. | |
| 5,110,080 | A | * | 5/1992 | Rieman | 248/225.1 |
| 5,127,341 | A | | 7/1992 | Wiklund | |
| 5,255,803 | A | | 10/1993 | Pavone et al. | |
| 5,372,262 | A | | 12/1994 | Benson et al. | |
| 5,407,262 | A | | 4/1995 | Christian et al. | |
| 5,439,123 | A | * | 8/1995 | Nook | 211/187 |
| 5,529,192 | A | | 6/1996 | Conen et al. | |
| 5,566,844 | A | | 10/1996 | Bernardin | |
| 5,573,124 | A | | 11/1996 | Frost | |
| 5,582,116 | A | * | 12/1996 | Spimpolo | 108/108 |
| 5,605,238 | A | | 2/1997 | Jacobs | |
| 5,607,070 | A | | 3/1997 | Hellyer | |
| 5,660,287 | A | * | 8/1997 | Tryon | 211/186 |
| 5,697,507 | A | | 12/1997 | Blass | |
| 5,715,957 | A | * | 2/1998 | Merl | 211/187 |
| 5,722,544 | A | | 3/1998 | Williams | |
| 5,819,958 | A | * | 10/1998 | Dement | 211/90.01 |
| 5,906,079 | A | * | 5/1999 | Brickner et al. | 52/239 |
| 5,918,750 | A | | 7/1999 | Jackson | |
| 5,938,367 | A | * | 8/1999 | Olson | 40/254 |

* cited by examiner

*Primary Examiner*—Daniel P. Stodola
*Assistant Examiner*—Khoa Tran
(74) *Attorney, Agent, or Firm*—Michael Best & Friedrich

(57) ABSTRACT

A shelving display system comprising a conventional gondola made up of a generally horizontal base and at least two upstanding posts to which generally horizontal top and bottom tracks are attached. Support/display members, such as decorative panels, standards for shelf brackets and shelves, and partitions may be attached to the top and bottom tracks to complete the system.

22 Claims, 9 Drawing Sheets

ADJUSTABLE SHELVING/DISPLAY SYSTEM

This application claims the benefit of Provisional Application No. 60/126,457, filed Mar. 26, 1999.

FIELD OF THE INVENTION

This invention relates generally to shelving display systems and, more particularly, to a system for improving conventional gondola shelving units both functionally and aesthetically, thereby providing a more useful shelving display product.

BACKGROUND OF THE INVENTION

A conventional prior art gondola 10 is illustrated in FIG. 1. This gondola is often referred to as a "half gondola", since its base 12 extends only forward from upstanding base posts 14 and 16. In a "full gondola", the base extends on both sides of the line defined by posts 14 and 16. Base posts 14 and 16 are attached to the gondola by conventional attachment means. Such conventional attachment means include preformed apertures in the base for receiving the distal ends of the posts. In this arrangement, means are provided for locking the posts in place using, for example, a locking bolt mounted in the base that engages the post surface. Alternatively, the posts may be bolted to outside vertical surfaces of the base. In another, less common arrangement, the posts may be part of a supporting skeletal structure which is covered with outer boards to form the base.

Posts 14 and 16 of gondola 10 include a series of spaced apertures 18 on the front surfaces 19 of the posts. The gondola also includes a series of shelves 20*a*, 20*b*, and 20*c* resting respectively on shelf brackets 22*a*, 22*b*, and 22*c*. The shelf brackets are mounted in apertures 18 of the base posts. In a full gondola, the posts would have apertures on their front and rear surfaces, and shelf brackets and shelves would be mounted to the apertures on the front and rear surfaces of the posts.

While conventional gondolas of the type illustrated in FIG. 1 are highly functional and widely used, they do have certain shortcomings. For example, only one horizontal shelf can be located at a particular height, and the shelf lengths are determined by the spacing between the posts to which the shelves are mounted. Also, there is no convenient way to create visual pause points along the shelves. As a result, it is difficult to support and display different sizes and types of items on a single gondola or to create varying, visually pleasing configurations.

Thus, a shelving display system which accepts shelves of varying lengths and permits mounting of different shelves at varying heights would be highly desirable. Additionally, a shelving display system which permits easy placement of pause point partitions between shelves on a single gondola would also be desirable.

The present invention provides such a system, as demonstrated in FIG. 2. As illustrated in FIG. 2, the present system, identified by numeral 23, accommodates five different shelf widths in five columns divided by pause point partitions 25. The first and widest series of shelves 24 accepts rugs 27 that are best displayed when folded to a substantial width. The second, third and fourth columns of shelves 26, 28, and 30, are spaced to accept pillows 29 of varying sizes. Additionally, the shelves in these sections are at varying heights, to improve the visual interest of the shelving display system. A column of shelves 30 is provided for blankets 31, which, like the rugs in the first column of shelves, are best displayed in a wide folded configuration.

Lastly, signage is provided at the tops of the columns identifying the goods (blankets, pillows and rugs) displayed below. The system illustrated in FIG. 2 include s an end display 32 resting on the gondola base at the right of the system. The shelving display system of FIG. 2 is thus far more functional and aesthetically pleasing than the conventional gondola unit of FIG. 1.

SUMMARY OF THE INVENTION

The present invention is directed to a shelving display system constructed on a conventional gondola shelving unit. The gondola shelving unit includes a generally horizontal base and at least two upstanding base posts. The gondola may be provided with wheels on its underside to permit it to be moved from place to place. In accordance with the invention, generally horizontal top and bottom tracks are attached to the base posts. Then, support/display members are attached to the top and bottom tracks at the desired locations. One or both of the tracks may be provided with a series of apertures for receiving attachment devices associated with the support/display members.

In one embodiment, the support/display members include at least one decorative panel. This decorative panel is mounted between the top and bottom tracks. Vertically directed slots may be provided in one or both of the top and bottom tracks in o order to facilitate the mounting of the panel.

In another preferred embodiment, support/display members in the form of vertical pause point partitions are provided. The pause point partitions may be attached to the top and bottom tracks at locations dictated by the desired display system configuration.

In yet another desirable embodiment, the support/display members include at least two generally vertical standards attached to the top and bottom tracks. These standards are configured to receive conventional shelf brackets. Since the standards may be attached at varying locations on the top and bottom tracks dictated by the desired system configuration, the system will accommodate a broad range of shelf lengths.

The objects, features and advantages of the present invention, as highlighted above, will be further described in the following description, drawings and claims.

DETAILED DESCRIPTION OF THE INVENTION

Figure 1:
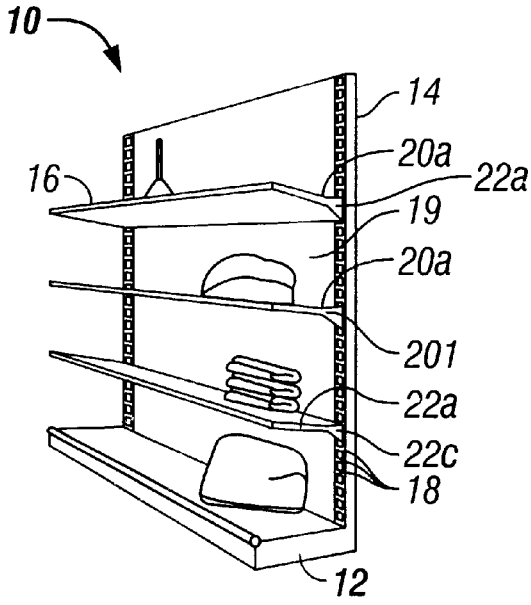
FIG. 1 (Prior Art)
FIG. 1 is a perspective view of a prior art half-gondola.
Figure 2:
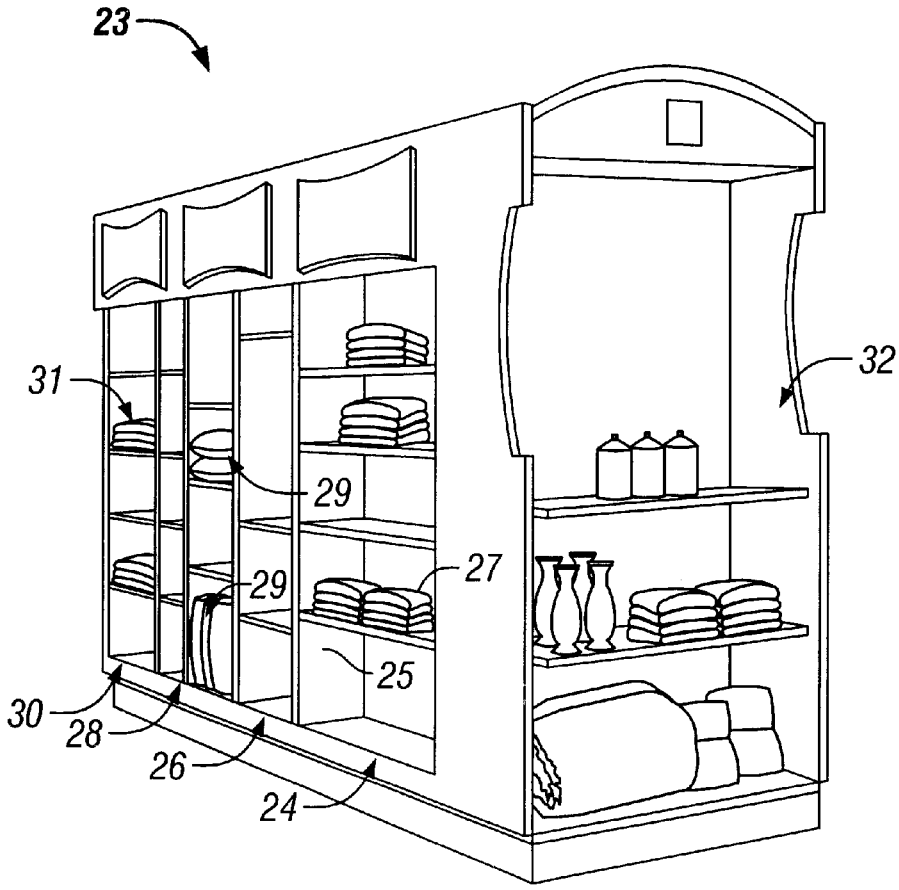
FIG. 2 is a perspective view of a fully assembled shelving/display system in accordance with the present invention.
Figure 3:
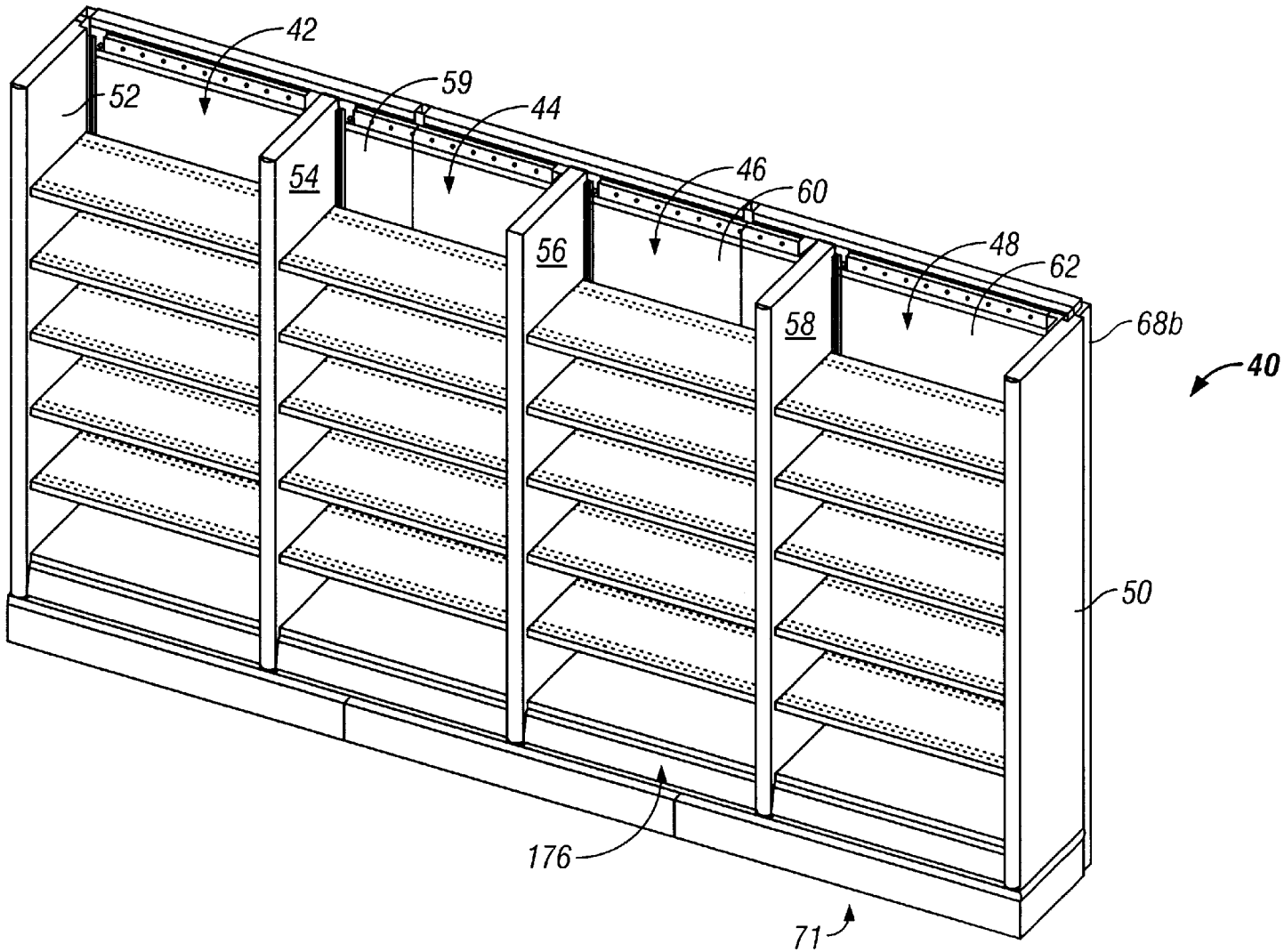
FIG. 3 is a perspective view of another shelving/display system in accordance with the present invention.

Turning now to FIG. 3, a shelving display system 40 is illustrated. Shelving display system 40 includes four evenly-spaced columns of shelves 42, 44, 46, and 48 with end caps 50 and 52, and pause point partitions 54, 56, and 58 between the four columns of shelves. Although columns of shelves 42, 44, 46, and 48 are evenly spaced in this Figure, these columns may be of varying widths, as in FIG. 2. Additionally, decorative panels 59, 60, and 62 are provided to form a backdrop for the system.

Figure 4:
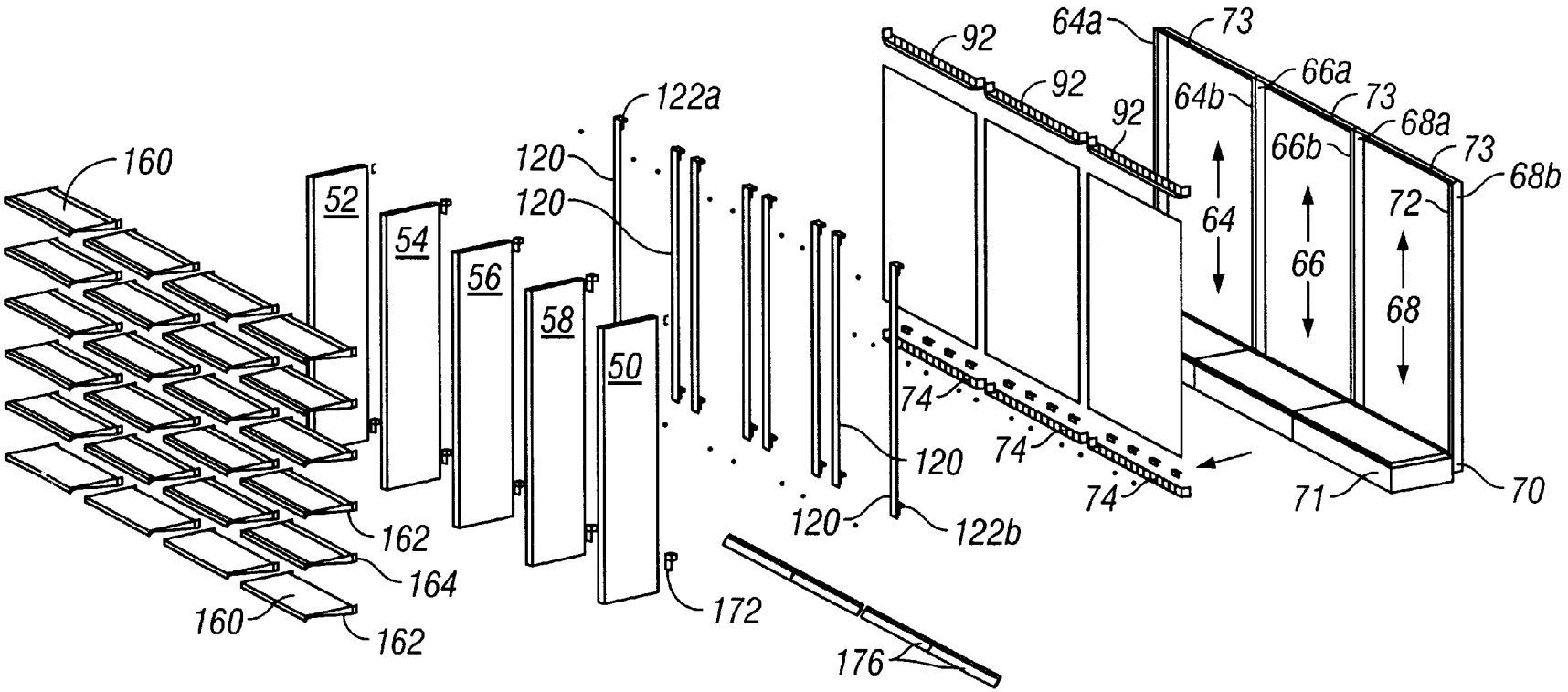
FIG. 4 is an exploded view of the system shown in FIG. 3.

FIG. 4 is an exploded view of the shelving display system of FIG. 3. Beginning at the right hand edge of the view, a series of three conventional gondola units, 64, 66, and 68, are illustrated, each having a pair of upstanding base posts (64*a* and 64*b*, 66*a* and 66*b* and 68*a* and 68*b*, respectively) bolted to rear corners 70 of each base 71, along the rear vertical surface of the base. These upstanding posts include a series of apertures 72 running their entire length. Additionally, optional horizontal stabilizer rails 73 are attached to each pair of posts to help stabilize the posts of the gondola units. Although the upstanding posts are shown attached at opposite ends of the bases, one or both posts may be located in apertures in the base at intermediate locations leaving the base with clear end areas so that, for example, other display and support units may be placed on these end areas as, for example, at 32 in FIG. 2. Also, where long bases are used or where extra support is desired, more than two upstanding posts may be used.

Figure 5:
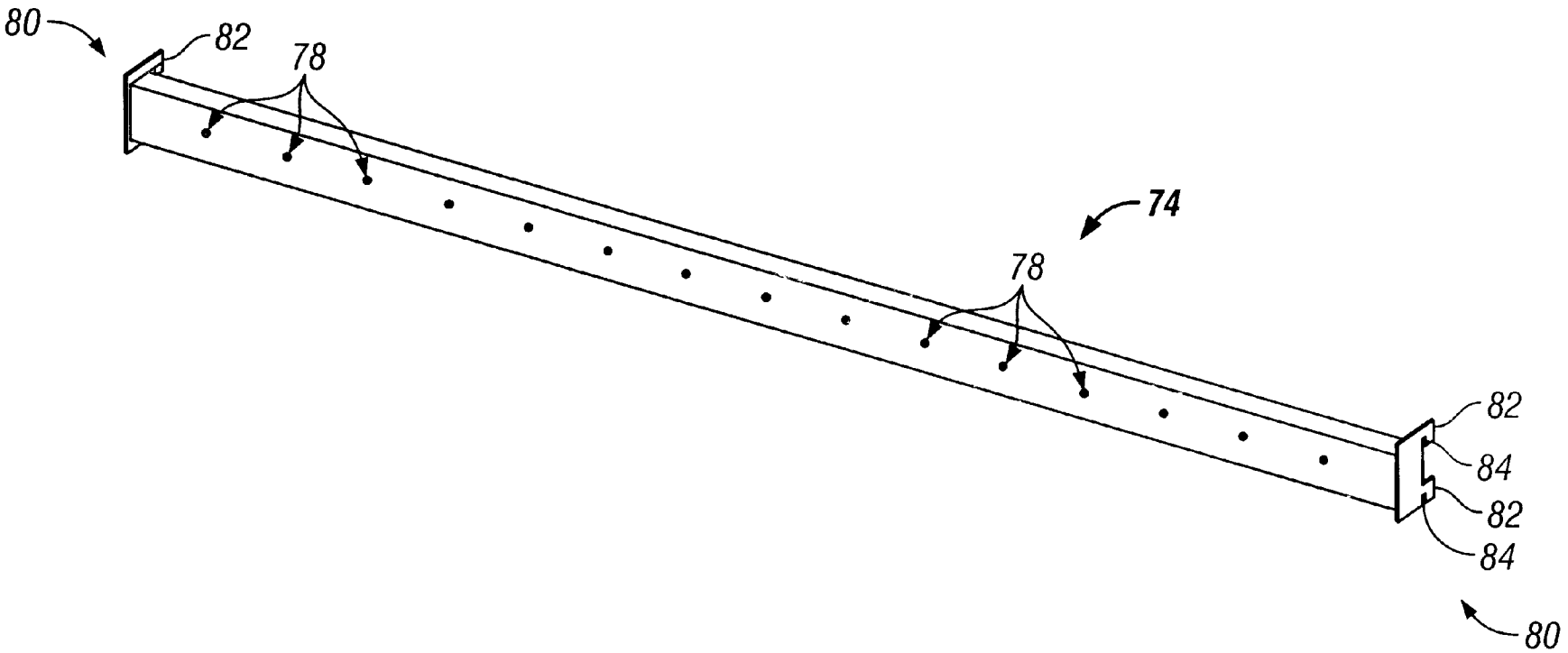
FIG. 5 is a perspective view of a track intended to be mounted horizontally in the shelving/display system of the present invention.
Figure 7:
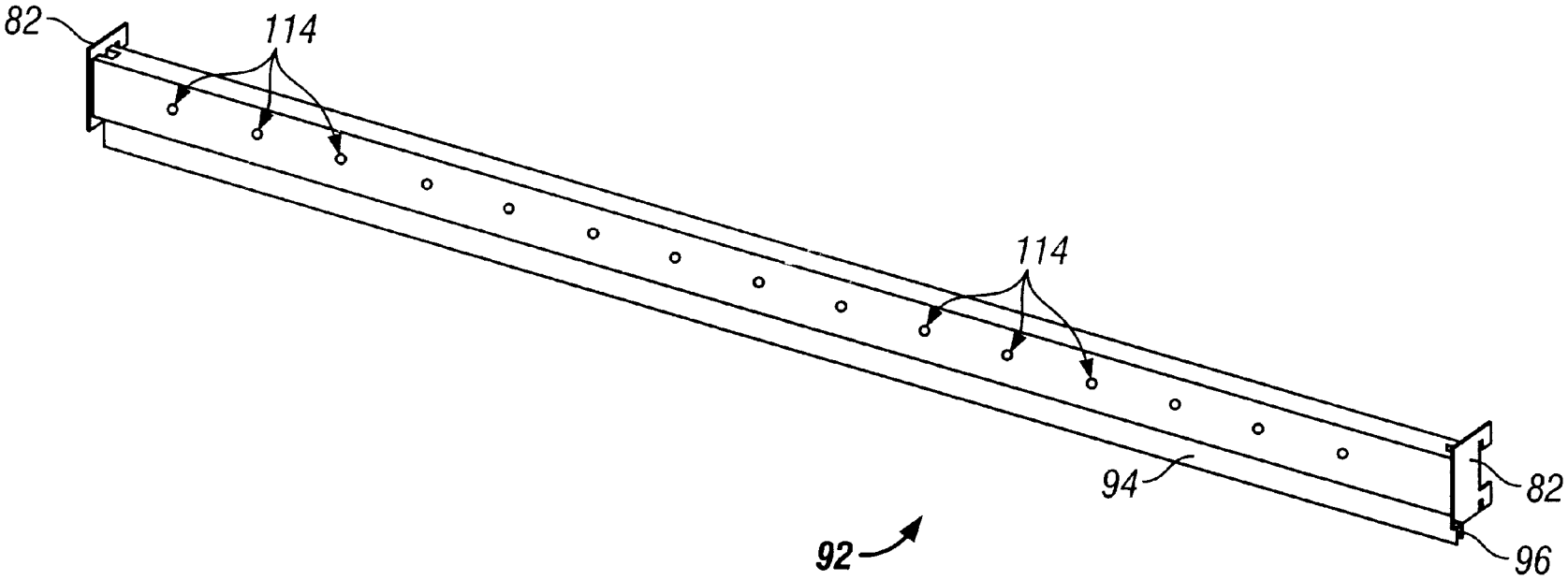
FIG. 7 is a perspective view of another track, comprising an alternative design to that of FIG. 5.

Continuing left in FIG. 4, a series of three generally horizontal top tracks 92 and three generally horizontal bottom tracks 74, in accordance with the invention, are shown. These tracks, which are illustrated in greater detail in FIGS. 5 and 7, are mounted in the desired apertures 72 of posts 64*a* and 64*b*, 66*a* and 66*b*, and 68*a* and 68*b*. As shown in FIG. 5, track 74 has a series of apertures 78 along its length and mounting brackets 80 at either end. Although apertures 78 are illustrated as round through-holes, they may be blind holes and of any shape or depth which will receive and hold the engagement section of associated locking member with a shelf/display member. Alternatively, the tracks need not be provided with apertures in which case the shelf/display members will be fastened by alternate means such as clamp devices.

Mounting brackets 80 have downwardly projecting prongs 82. Thus, the horizontal tracks may be mounted to the upstanding posts at either end of each gondola by pushing prongs 82 into the apertures of the posts at the desired height, and then locking the track into place by forcing it downward so that the slots 84 in the brackets engage a portion of the posts just below each aperture holding a prong. This mounting system generally follows that already known for mounting shelf brackets to upstanding posts of conventional gondola units.

Figure 6:
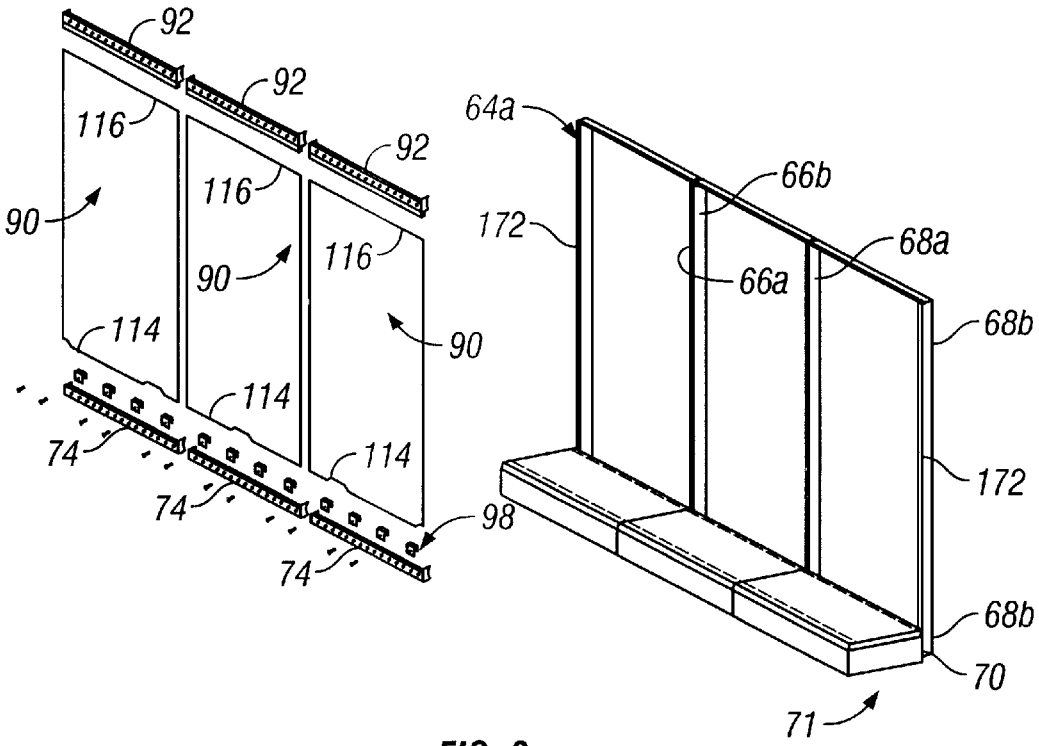
FIG. 6 is a partial exploded view of the embodiment of FIG. 3, illustrating the positioning of the decorative panels of the system.
Figure 8:
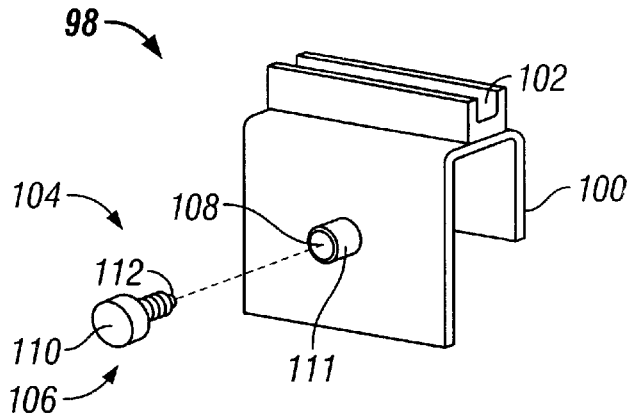
FIG. 8 is a perspective view of a mounting bracket designed for attachment to the tracks of FIGS. 5 and 7.

The retention or mounting of decorative panels 59, 60 and 62 may be best understood by reference to FIGS. 6, 7, and 8. Beginning in FIG. 6, panels 59, 60 and 62 are shown juxtaposed below specially adapted horizontal tracks 92. As illustrated in FIG. 7, each track 92 is provided with a downwardly projecting portion 94 defining a downwardly projecting panel retention space or slot 96. The width of slot 96 will be slightly greater than that of the decorative panels, so that the panels can be slid into the slots and retained there, as explained below. Next, three tracks 74 are juxtaposed below the panels with a series of releasable locking elements or panel brackets 98 between the panels and the tracks.

Figure 9:
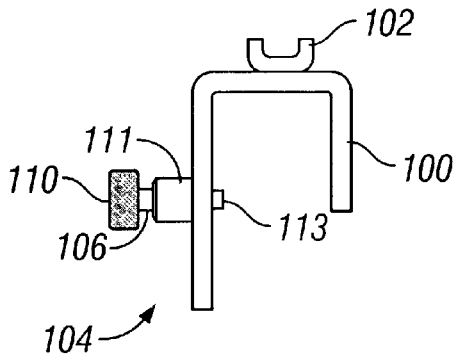
FIG. 9 is a side elevation view of the bracket of FIG. 8.
Figure 10:
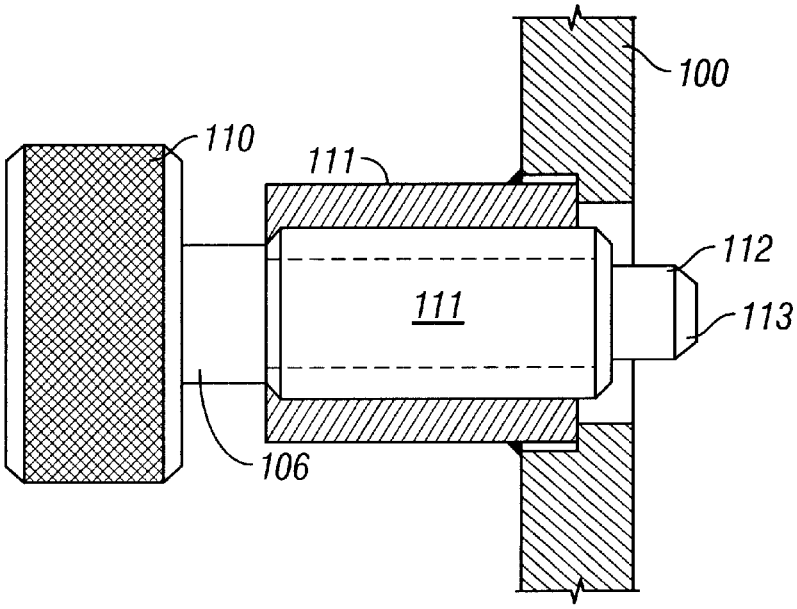
FIG. 10 is an enlarged cross-sectional view of the bracket of FIGS. 8 and 9.

As shown in FIGS. 8, 9 and 10, panel brackets 98 include a saddle portion 100, an upper panel retention trough 102, and a locking member 104. Locking member 104 includes a spring biased plunger 106 which fits through an aperture 108 in the front wall of the saddle portion. Plunger 106 is attached to a spring within collar 111 which biases the plunger into the rest or engagement position shown in FIG. 8. The plunger includes a head portion 110 and an engagement portion 112 having a guide tip 113. Engagement portion 112 is sized and positioned to engage and to rest within any one of apertures 114 in track 92. Guide tip 113 helps guide the plunger into the desired aperture. Thus, the locking member is pulled out and the retainer placed on the track and slid along the track until guide tip 113 is opposite the desired aperture in the track, whereupon the locking element is released and both engages and is held in place by the spring action of the biasing spring.

The decorative panels are mounted by first positioning locking members 104 along tracks 74 by retracting the plungers 106, positioning the locking members at the desired locations on the tracks, and releasing the spring-biased plungers to fix the locking members in place. Then each of the panels in turn is positioned opposite a slot 96 in its respective panel track 74 and pushed up into the slot, whereupon the saddle portions of the locking brackets on each lower track 74 are slid onto the bottom edge 114 of the corresponding panel, and the lower tracks are attached to the corresponding pair of upstanding posts 64*b*, 66*a* and 66*b* , and 68*a* and 68*b* by pushing prongs 82 into apertures 78 and allowing the prongs to drop into place as the panel slides downwardly in slot 96 a short distance while the top edge 116 of each panel remains in the slot. The panel is thus fixed in place.

In alternative embodiments, the positions of the top panel track and bottom track may reversed. In this embodiment, the panels would first be dropped into the slots in the bottom panel tracks, and then the top tracks would be attached to the panel top edges and then mounted to the upstanding posts with the top edges positioned in the panel retention troughs. In a further embodiment, identical tracks could be used on the top and bottom, with locking brackets along each track. In yet another alternative embodiment, top and bottom tracks with slots could be used.

Figure 13:
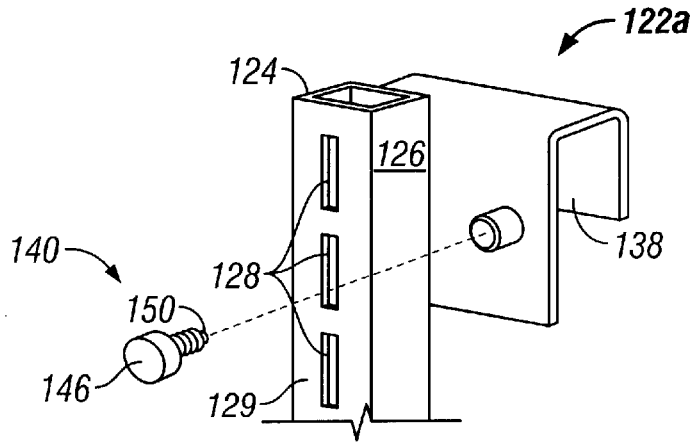
Figure 11:
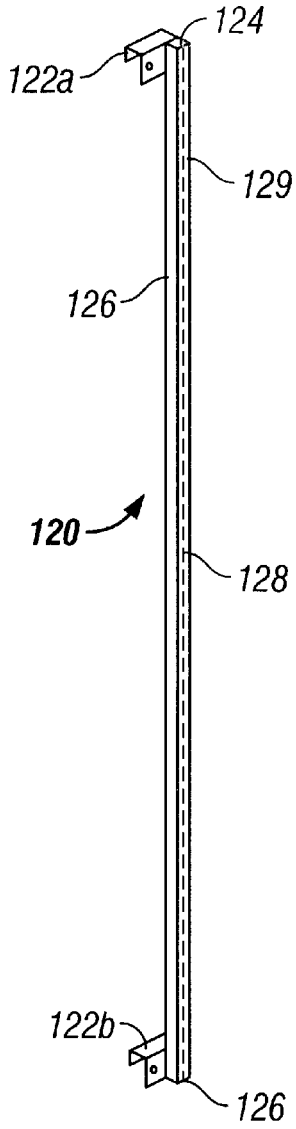
FIG. 11 is a perspective view of a vertical standard having brackets at either end for attachment to the tracks of FIGS. 5 and 7.

The attachment of the columns of shelves 42, 44, 46 and 48 of FIGS. 3 and 4 will now be described beginning with reference to FIG. 11. First, the system is provided with a series of conventional standards 120, modified by attaching at least two standard brackets 122*a* and 122*b*, preferably at the top and bottom ends, 124 and 126, respectively, of the standards. The brackets may be spot welded to the standards. These standards are, as illustrated, conventional square posts 126 having elongated slots 128 at least along their front surface 129. Posts 126 need not be square and variations may be made in the shape or size of the apertures. Furthermore, brackets 122*a* and 122*b* need not be attached at the ends of the standards, but may be attached at locations spaced from one or both ends of the standards. Brackets 122*a* and 122*b* which are intended to rest on top and bottom tracks 92 and 74 may be centered on the standards, or they maybe offset to the left as in FIG. 11, or to the right. Thus, the left offset bracket of FIG. 11 is best adapted to be used on the extreme right edges of a pair of tracks, whereas a standard which has a pair of brackets offset to the right is best adapted to be positioned at the extreme left ends of a pair of tracks (FIG. 13). Should it be desired to make the brackets the same width as the standards, the brackets may be centered on the backs of the standards. Also, the attachment brackets may be fixed to the standards with a portion of its back surface protruding above and below the ends of the standard.

Figure 12:
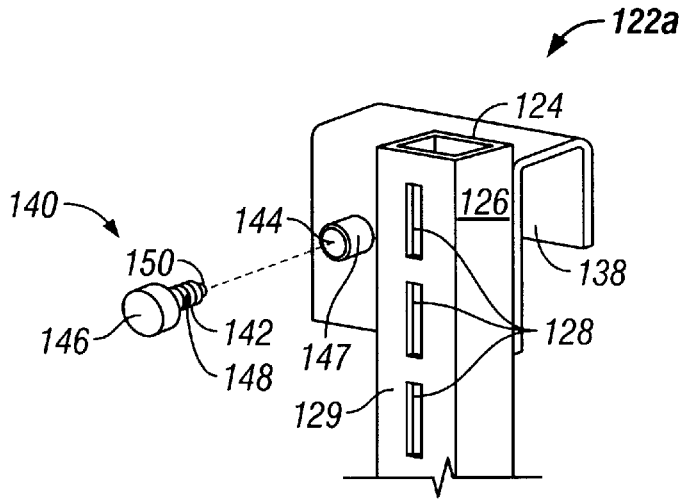
FIGS. 12 and 13 are partial views of standards in accordance with the present invention in which brackets are attached respectively protruding left and protruding right.

In FIG. 4, pairs of brackets 122*a* and 122*b* are shown, before attachment to their respective pairs of top and bottom tracks 92 and 74. As illustrated in the enlarged view of FIG. 12, bracket 122*a* includes a saddle portion 138 and a locking member 140. As in the case of panel brackets 98, these standard brackets include a spring biased plunger 142 which fits through an aperture 144 in the front wall of the saddle portion, and is attached to a spring within collar 147. Plunger 142 includes a head portion 146 and an engagement portion 148 having a guide tip 150. Again, as in the panel brackets, engagement portion 148 is sized and positioned to engage and rest within any one of the apertures in tracks 74 and 92. Thus, plunger 142 is retracted and the standards positioned on the track and slid along until guide tip 150 is opposite the desired aperture in either the top or bottom track, whereupon the plunger is released to lock the end of the standard in place on the track.

Figure 14:
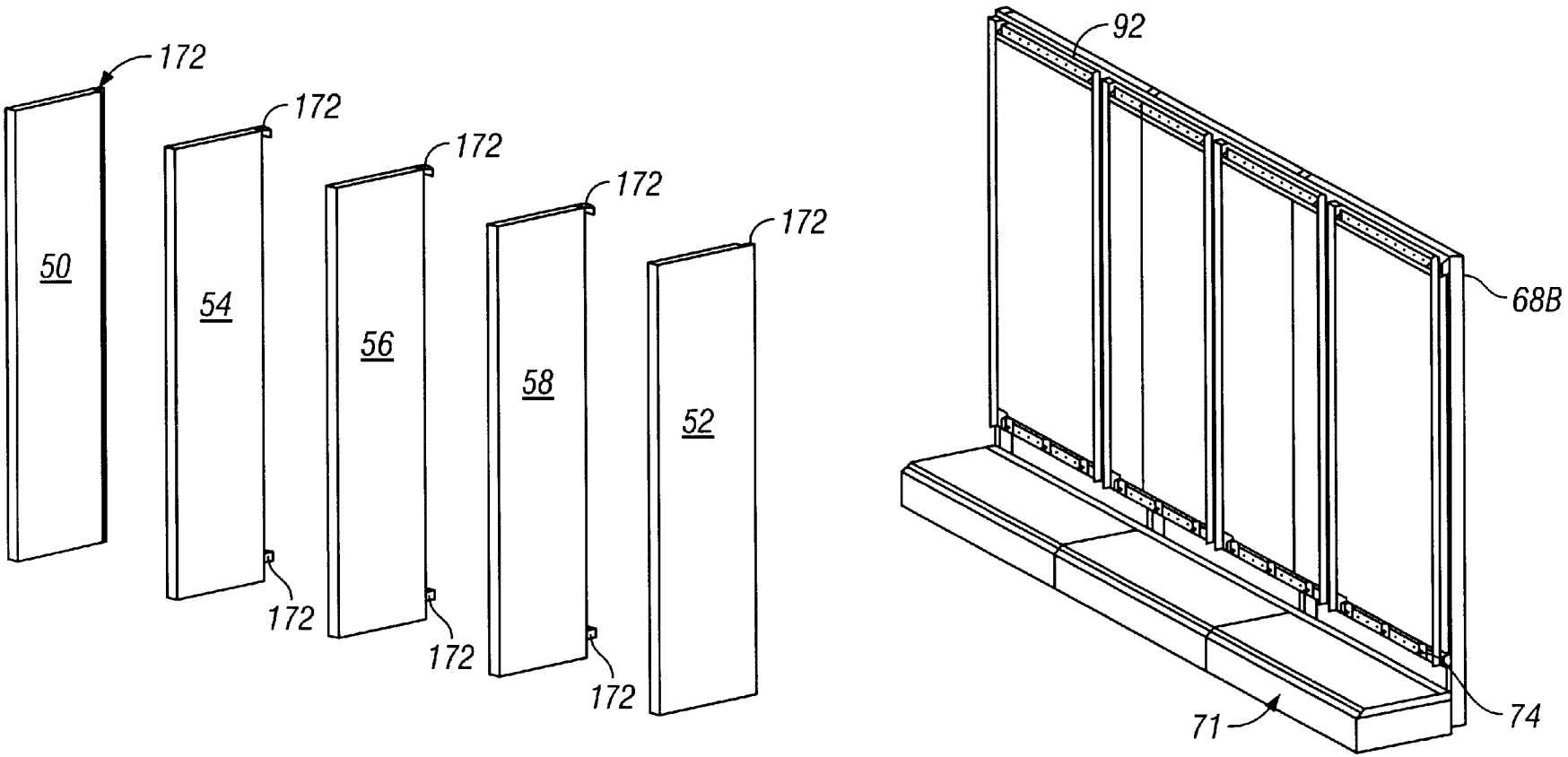
FIG. 14 is a partial exploded view of the system of FIG. 3 showing partitions and end caps positioned for attachment.

A series of shelves 160 are illustrated in FIGS. 4 and 14, each having integrally formed brackets 162 at either side. Brackets 162 have hooks 164 at their rear edge. These hooks are of a size and shape which will engage slots 128 in the standards, in much the same way as conventional shelf brackets attach to conventional standards. Thus, the columns of shelves may be attached to the pairs of standards at the desired heights. If it is desired to use shelves of different widths, standards 120 are simply attached to the tracks at spacings corresponding to the desired shelf widths.

Figure 15:
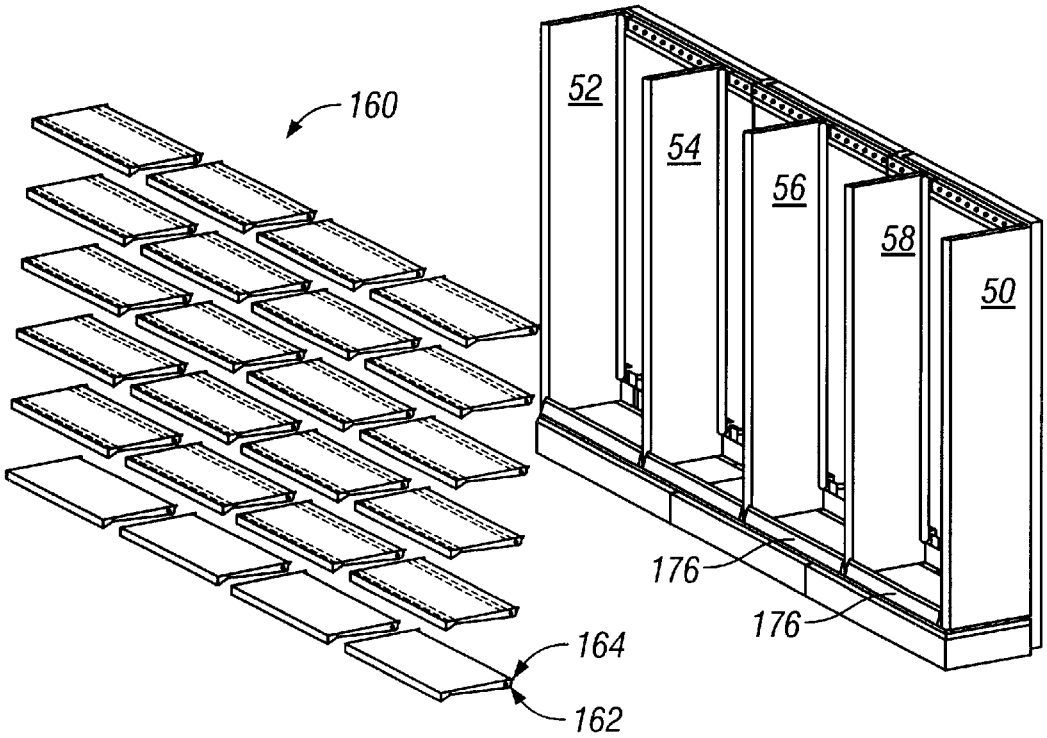
FIG. 15 is a partial exploded view of the system of FIG. 3 showing a series of shelves positioned for attachment to standards in the system.

In order to complete the shelf/display system of FIG. 3, end caps 50 and pause point partitions 52, 54, 56 and 58, must be attached to the tracks (FIGS. 14 and 15). Each of the partitions and end caps are provided with pairs of hooks 172, permitting them to be hung on the tracks at the ends of the system and between immediately adjacent pairs of standards. The end caps may be further restrained by hanging them by brackets to the spaced apertures in the upstanding base posts. Yet further restraint may be obtained where desired by securing each of the end caps at their bottom edge to the gondola base.

Lastly, covers 176 may also be attached to the front surfaces of the bases, to further decorate the system. These covers may be provided with labeling corresponding to the merchandise above, if desired. Alternatively, signage may be attached to the system at its top (FIG. 2) or elsewhere in the system by conventional means.

There has been described herein a shelving/display system capable of supporting and displaying different sizes and types of items on a single gondola, making it possible to create varying visually pleasing configurations in a manner that is free of the shortcomings of the prior art. It will be apparent to those skilled in the art that modifications may be made in the system without the departing from the spirit and scope of the invention. Accordingly, it is not intended that the invention be limited except as it may be necessary in view of the claims.

What we claim is:

1. An apparatus comprising:

a base;

two spaced apart upstanding posts secured to the base, each post having a plurality of vertically spaced apertures running along at least a portion of the length of the post;

top and bottom horizontal tracks extending between and secured to the posts, each track having a plurality of spaced apertures running along at least a portion of the length of the track;

a plurality of vertical standards extending between and secured to the top and bottom tracks, each standard having a plurality of spaced apart apertures running along at least a portion of the length of the standard;

a plurality of shelves removably secured to the standards in at least two columns wherein the vertical spacing of the shelves in each column can be adjusted independently of the vertical spacing of the shelves in the other column; and a vertical pause point partition independent of the shelves and extending between and removably secured to the top and bottom tracks to separate at least two columns of shelves, wherein the shelves are secured to the standards independently of the pause point partition.

2. The apparatus of claim 1 wherein the vertical standards include connectors for removable engagement in selected apertures on the top and bottom tracks.

3. The apparatus of claim 2 wherein the connectors comprise saddle connectors to fit over the tracks.

4. The apparatus of claim 3 wherein the saddle connectors comprise a retractable element for engaging the selected track aperture.

5. The apparatus of claim 4 wherein the retractable element is a spring biased plunger.

6. The apparatus of claim 1 further comprising a decorative panel extending between and removably secured to the top and bottom tracks.

7. The apparatus of claim 6 wherein the panel has a top edge and the top track defines a downwardly extending slot for receiving the top edge of the panel.

8. The apparatus of claim 7 wherein the panel has a bottom connector for removable engagement with selected apertures on the bottom track.

9. The apparatus of claim 1 wherein each of the plurality of shelves includes rear connectors for removable engagement in selected apertures on the vertical standards so that the shelves are cantilevered from the standards at selected vertical spacings from each other and each vertical partition includes rear connectors for removable engagement in selected apertures on the top and bottom tracks at any desired location along the length of the tracks so that the partitions can be positioned between the columns of shelves.

10. The apparatus of claim 9 wherein the top and bottom tracks include connectors for removable engagement in selected apertures on the posts at any desired height along the posts.

11. The apparatus of claim 1 wherein the rear panel connectors comprise hooks for engaging the selected track aperture.

12. An apparatus comprising:

a base;

two spaced apart upstanding posts secured to the base, each post having a plurality of vertically spaced apertures running along at least a portion of the length of the post;

top and bottom horizontal tracks extending between and secured to the posts, each track having a plurality of spaced apertures running along at least a portion of the length of the track;

a plurality of vertical standards extending between and secured to the top and bottom tracks, each standard having a plurality of spaced apart apertures running along at least a portion of the length of the standard;

a plurality of shelves removably secured to the standards in at least two vertically aligned columns with a vertical space therebetween wherein the vertical spacing of the shelves in each column can be adjusted independently of the vertical spacing of the shelves in the other column; and at least one vertical partition independent of the shelves and extending between and removably secured to the top and bottom tracks in the vertical space between the at least two shelf columns to separate the at least two columns of shelves, wherein each of the shelves and the at least one partition may be removed without disturbing the other of the shelves and the at least one partition.

13. The apparatus of claim 12 wherein the vertical standards include connectors for removable engagement in selected apertures on the top and bottom tracks.

14. The apparatus of claim 13 wherein the connectors comprise saddle connectors to fit over the tracks.

15. The apparatus of claim 14 wherein the saddle connectors comprise a retractable element for engaging the selected track aperture.

16. The apparatus of claim 15 wherein the retractable element is a spring biased plunger.

17. The apparatus of claim 12 further comprising a decorative panel extending between and removably secured to the top and bottom tracks.

18. The apparatus of claim 17 wherein the panel has a top edge and the top track defines a downwardly extending slot for receiving the top edge of the panel.

19. The apparatus of claim 18 wherein the panel has a bottom connector for removable engagement with selected apertures on the bottom track.

20. The apparatus of claim 12 wherein each of the plurality of shelves includes rear connectors for removable engagement in selected apertures on the vertical standards so that the shelves are cantilevered from the standards at selected vertical spacings from each other and each vertical partition includes rear connectors for removable engagement in selected apertures on the top and bottom tracks at any desired location along the length of the tracks so that the partitions can be positioned between the columns of shelves.

21. The apparatus of claim 20 wherein the top and bottom tracks include connectors for removable engagement in selected apertures on the posts at any desired height along the posts.

22. The apparatus of claim 12 wherein the rear panel connectors comprise hooks for engaging the selected track aperture.

* * * * *